US007850175B2

(12) United States Patent
Wegener

(10) Patent No.: US 7,850,175 B2
(45) Date of Patent: Dec. 14, 2010

(54) FOOTWEAR WITH ADJUSTABLE WHEEL ASSEMBLY

(76) Inventor: Andreas C. Wegener, 2435 Cades Way, Suite B, Vista, CA (US) 92081

( * ) Notice: Subject to any disclaimer, the term of this patent is extended or adjusted under 35 U.S.C. 154(b) by 353 days.

(21) Appl. No.: 12/055,153

(22) Filed: Mar. 25, 2008

(65) Prior Publication Data

US 2008/0235990 A1 Oct. 2, 2008

Related U.S. Application Data

(60) Provisional application No. 60/908,889, filed on Mar. 29, 2007.

(51) Int. Cl.
*A63C 17/00* (2006.01)

(52) U.S. Cl. ..... 280/11.19; 280/7.13; 280/11.223; 36/115

(58) Field of Classification Search ..... 280/7.13, 280/8, 11.19, 11.204, 11.24, 11.27, 11.28, 280/11.3, 11.31, 841, 843, 11.223; 36/100, 36/115, 82, 36 R, 36 B, 34 A, 34 B
See application file for complete search history.

(56) References Cited

U.S. PATENT DOCUMENTS 1,122,107 A * 12/1914 Halvers ..... 36/36 R
1,219,551 A * 3/1917 Hain ..... 36/36 R
2,095,942 A * 10/1937 Wetterstrand ..... 280/7.13
3,112,119 A * 11/1963 Sweet ..... 280/11.209
4,417,737 A * 11/1983 Suroff ..... 280/11.115
4,573,279 A * 3/1986 Feurer-Zogel et al. ..... 36/35 R
5,398,970 A 3/1995 Tucky
5,511,824 A 4/1996 Kim
5,797,609 A 8/1998 Fichepain
5,803,469 A * 9/1998 Yoham ..... 280/11.27
5,954,348 A 9/1999 Santarsiero et al.
6,059,062 A 5/2000 Staelin et al.
6,120,039 A 9/2000 Clementi
6,247,708 B1 6/2001 Hsu
6,354,609 B1 3/2002 Chen et al.
6,386,555 B1 * 5/2002 Kao ..... 280/7.13
6,406,037 B2 * 6/2002 Chang ..... 280/11.19
6,406,039 B1 * 6/2002 Chen ..... 280/11.27
D459,777 S 7/2002 Yang
6,412,791 B1 * 7/2002 Chu ..... 280/11.19
6,464,236 B2 * 10/2002 Chang ..... 280/11.223
6,474,661 B1 * 11/2002 Chang ..... 280/11.19
6,488,289 B2 12/2002 Hsiao et al.

(Continued)

FOREIGN PATENT DOCUMENTS

WO 2005/120664 12/2005

*Primary Examiner*—S. Joseph Morano
*Assistant Examiner*—Brodie Follman
(74) *Attorney, Agent, or Firm*—Procopio, Cory, Hargreaves & Savitch LLP

(57) ABSTRACT

Footwear has a sole for supporting a foot of a wearer, a first pair of wheels projecting from opposite sides of the sole adjacent the heel, and a second pair of wheels spaced in front of the first pair and projecting from opposite sides of the sole adjacent the arch portion of the sole. The footwear is convertible from a wheeled configuration to a non-wheeled configuration by opening a cover plate normally covering a downwardly facing, recessed region of the heel, removing the wheel axles from wheel axle mounting grooves in the recessed region, then re-closing the cover plate over the heel region.

20 Claims, 20 Drawing Sheets

U.S. PATENT DOCUMENTS

| | | | | |
|---|---|---|---|---|
| 6,523,836 | B1 * | 2/2003 | Chang et al. | 280/11.223 |
| 6,536,785 | B2 | 3/2003 | Lee | |
| 6,629,698 | B2 * | 10/2003 | Chu | 280/11.19 |
| 6,719,304 | B2 * | 4/2004 | Miller et al. | 280/11.27 |
| 6,805,363 | B2 | 10/2004 | Hernandez | |
| 7,063,336 | B2 | 6/2006 | Adams | |
| 7,165,773 | B2 | 1/2007 | Adams | |
| 7,165,774 | B2 | 1/2007 | Adams | |
| 7,195,251 | B2 * | 3/2007 | Walker | 280/11.19 |
| 7,407,167 | B1 * | 8/2008 | Chou | 280/7.13 |
| 7,497,446 | B2 * | 3/2009 | Yang | 280/11.27 |
| 7,712,749 | B2 * | 5/2010 | Moon et al. | 280/11.19 |
| 2001/0050467 | A1 * | 12/2001 | Clementi | 280/11.28 |
| 2002/0125655 | A1 * | 9/2002 | Hsiao et al. | 280/11.19 |
| 2002/0145263 | A1 * | 10/2002 | Yang | 280/11.19 |
| 2003/0038432 | A1 * | 2/2003 | Chang | 280/11.204 |
| 2003/0141680 | A1 | 7/2003 | Clark et al. | |
| 2004/0036237 | A1 * | 2/2004 | Hernandez | 280/11.3 |
| 2004/0239056 | A1 * | 12/2004 | Cho et al. | 280/7.1 |
| 2006/0232027 | A1 * | 10/2006 | Adams | 280/11.19 |
| 2007/0029742 | A1 * | 2/2007 | Shing | 280/11.221 |
| 2007/0164521 | A1 * | 7/2007 | Robinson | 280/11.19 |
| 2007/0252351 | A1 * | 11/2007 | McNamara | 280/11.24 |
| 2008/0235990 | A1 * | 10/2008 | Wegener | 36/100 |
| 2008/0256831 | A1 * | 10/2008 | Maiores | 36/115 |
| 2009/0033046 | A1 * | 2/2009 | Wilborn | 280/11.19 |
| 2009/0200763 | A1 * | 8/2009 | Adams et al. | 280/11.19 |
| 2010/0050481 | A1 * | 3/2010 | Stockbridge et al. | 36/30 R |

* cited by examiner

FOOTWEAR WITH ADJUSTABLE WHEEL ASSEMBLY

RELATED APPLICATION

The present application claims the benefit of U.S. provisional application No. 60/908,889 filed Mar. 29, 2007, which is incorporated herein by reference in its entirety.

BACKGROUND

1. Field of the Invention

The present invention relates generally to footwear such as shoes, sandals and the like, and is particularly concerned with footwear having wheels in the heel region.

2. Related Art

Footwear with one wheel or a pair of wheels embedded in the sole at the heel region is known. The wearer of such footwear can choose to walk or run by tilting the feet forwards so that only the forward portion of the sole, without the wheel or wheels, engages the ground. In order to roll on the wheel or wheels, the wearer tilts their legs backwards with the front of the feet raised so that the wheel or wheels are in rolling engagement with the ground. Footwear with a single pair of external wheels extending on opposite sides of the heel region adjacent the rear wall of the footwear is also known. A similar rearwardly tilted stance must also be adopted for rolling on these wheels.

The stance required for rolling or wheeling on such footwear is not particularly stable and requires a significant amount of time to learn before the user is comfortable in such a stance. The rearward tilt of the legs also tends to cause some muscle strain.

Convertible roller footwear with removable wheels is also known, as described in U.S. Pat. No. 5,511,824 of Kim, for example. Rollers are removably inserted in axle openings on opposite sides of the sole of the shoe, with one pair of rollers located in the heel portion and the other pair located forward of the arch portion of the shoe.

SUMMARY

Embodiments described herein provide new footwear with an adjustable wheel assembly which can hold one pair of wheels or two pairs of wheels. All of the wheels can be removed to convert the shoe to a standard walking shoe.

According to one aspect, a footwear device has a sole for supporting a foot of a wearer, the sole having a heel portion having a rear end, an arch portion, and a forefoot portion having a forward end, a first pair of wheels projecting from opposite sides of the sole adjacent the heel portion, and a second pair of wheels projecting from opposite sides of the sole in front of the first pair of wheels and adjacent the arch portion of the sole. In one embodiment, the wheels are completely outside the sole of the shoe. In another embodiment, they may extend partially outside the sole of the shoe with inner regions located in recesses in opposite sides of the sole.

In one embodiment, the wheels of the second pair at least partially overlap the arch region of the sole. Each pair of wheels may be mounted on a single axle which extends through the sole of the shoe, and a reinforced region may be provided within the sole for supporting the axles.

The two pairs of wheels provide a relatively stable platform for wheeling or rolling, without requiring a large amount of rearward tilt, while the wearer of the footwear may tilt forwards in order to engage the forefoot region of the sole with the ground in order to brake or to walk or run.

According to another aspect, an adjustable wheel mounting assembly is provided in the heel portion of the sole of each shoe. The heel portion has a removable or hinged cover plate extending over three spaced axle mounting grooves in the remainder of the heel portion in the closed position. The central axle mounting groove is used for one pair of wheels, while the outer two are used for two pairs of wheels. The opposing sides of the cover plate and heel portion are adapted for mounting a removable fender insert for one or two pairs of wheels, and a removable grinding surface when only one pair of wheels is used. Alternatively, when no wheels are installed, the cover plate is simply closed and the shoe can be used as a standard walking shoe.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for footwear having an adjustable heel assembly which can be adjusted between a walking or running configuration and two different wheeled configurations.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 1:
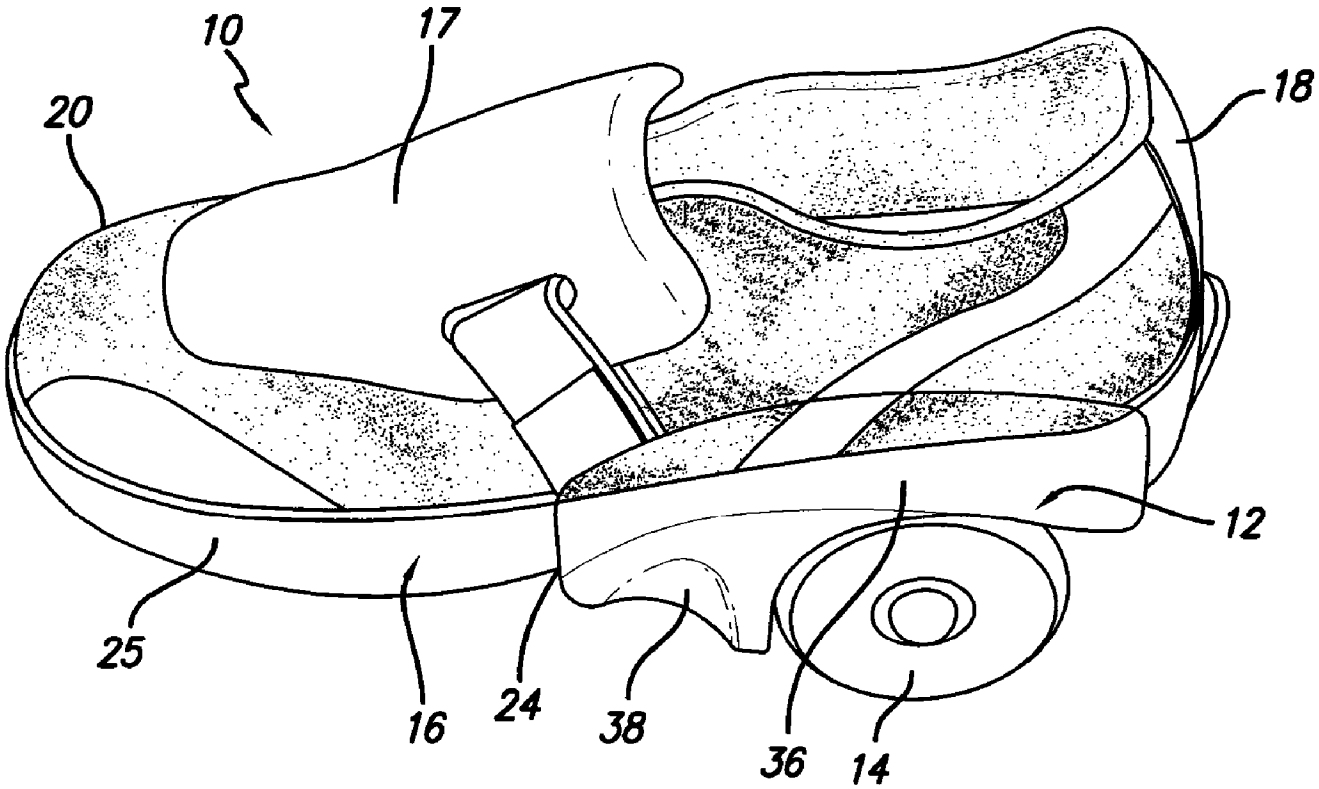
FIG. 1 is a perspective view of a shoe or footwear according to one embodiment, with a single pair of wheels installed in the heel portion of the sole of the shoe.
Figures 2, 3:
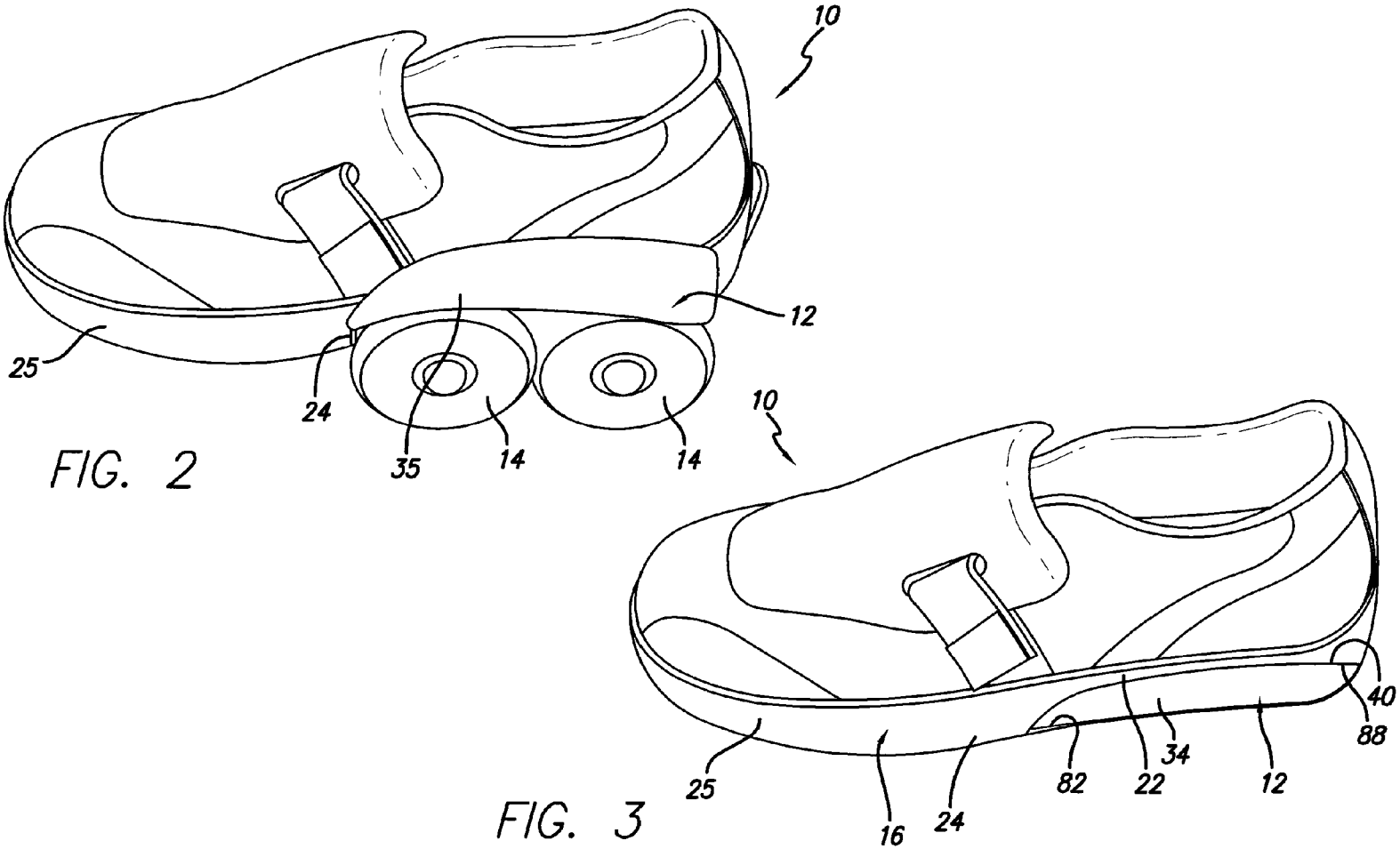
FIG. 2 is a perspective view of the shoe or footwear of FIG. 1, with two pairs of wheels installed in the heel portion of the sole of the shoe.
FIG. 3 is a perspective view of the shoe or footwear of FIGS. 1 and 2, with no wheels installed in the sole.

FIGS. 1 to 3 illustrate footwear 10 which has an adjustable wheel mounting assembly 12 in the sole 16 of the shoe at the heel portion, allowing the footwear to be worn with one pair of wheels 14 as in FIG. 1, two pairs of wheels 14 as in FIG. 2, or no wheels as in FIG. 3. The adjustable wheel mounting assembly is illustrated in detail in FIGS. 4 to 23. The footwear 10 in FIGS. 1 to 3 comprises a left shoe. The corresponding right shoe (not illustrated) of the pair is provided with similar first and second pairs of wheels. Although the footwear in the illustrated embodiment is an athletic style shoe, other types of footwear may be provided with an adjustable wheel mounting assembly in a similar manner in alternative embodiments, such as dress shoes, other styles of flat shoes, sandals, boots, and the like.

Shoe 10 has a sole 16 which supports the foot of a wearer and an upper 17 which forms an enclosure for receiving the wearer's foot and has a rear portion 18 which extends around the back of the wearer's heel and a forward portion 20 which extends over the top of the forward portion of a wearer's foot. The upper may be of different configurations in alternative embodiments. Sole 16 has a heel portion 22, an arch portion 24 which supports the arch of the wearer's foot, and a forefoot portion 25. The adjustable wheel mounting assembly 12 is incorporated in the heel portion of the sole.

Figure 4:
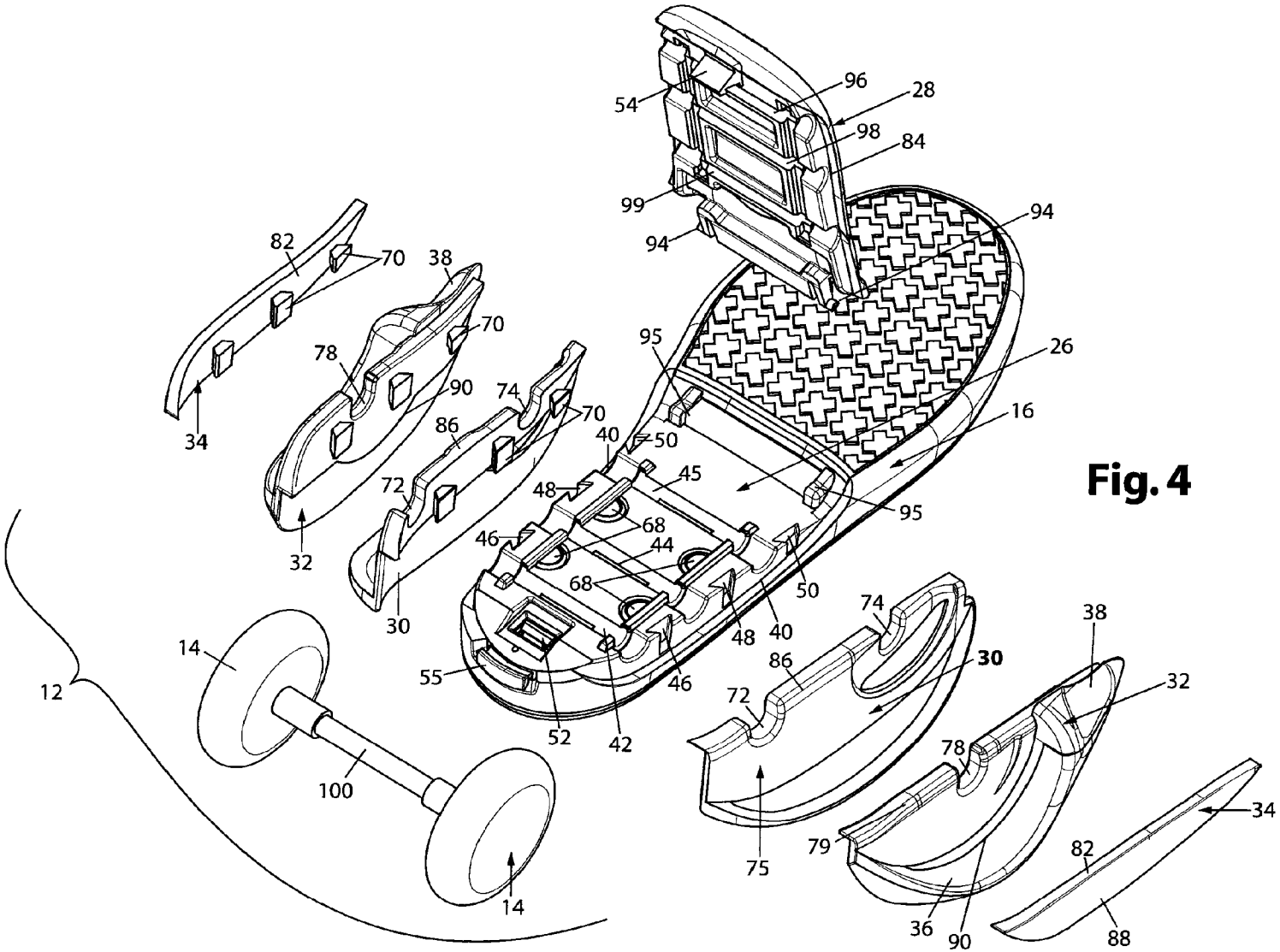
FIG. 4 is an exploded view of the sole of the shoe of FIGS. I to 3 and various parts of the wheel assembly which may be used to convert the sole for mounting one pair of wheels, two pairs of wheels, or no wheels.

The components of the adjustable wheel mounting assembly 12 are shown separately in FIG. 4. The sole 16 is shown on its own without the shoe upper 17 attached in FIGS. 4 to 23, for reasons of clarity, but the sole 16 is permanently attached to the shoe upper in a conventional manner and all conversions between two pairs of wheels, one pair of wheels, and no wheels as illustrated in these drawings are made with the entire assembled shoe in place, as in FIGS. 1 to 3. In order to convert from one configuration to another, the user simply places the shoe upside down with the undersurface uppermost while changing the configuration, as discussed below in connection with FIGS. 9 to 23.

Figure 8:
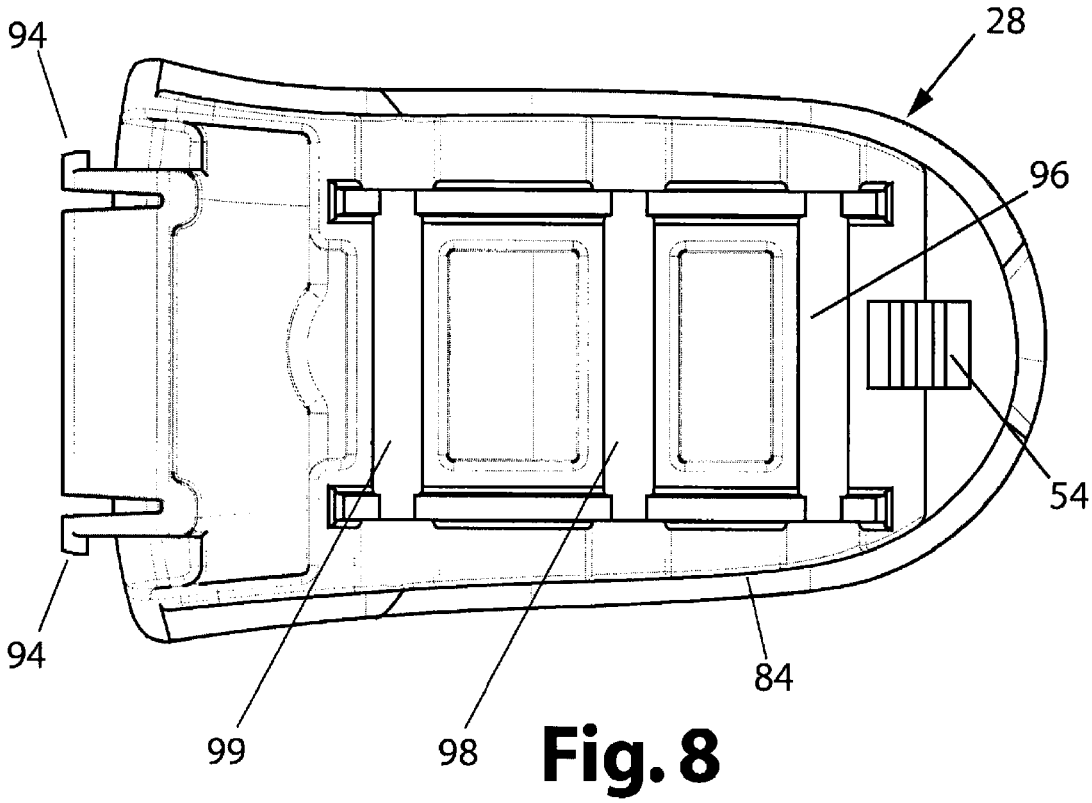
FIG. 8 is a top plan view or inner face view of the heel cover plate of FIGS. 4 and 7.
Figure 9:
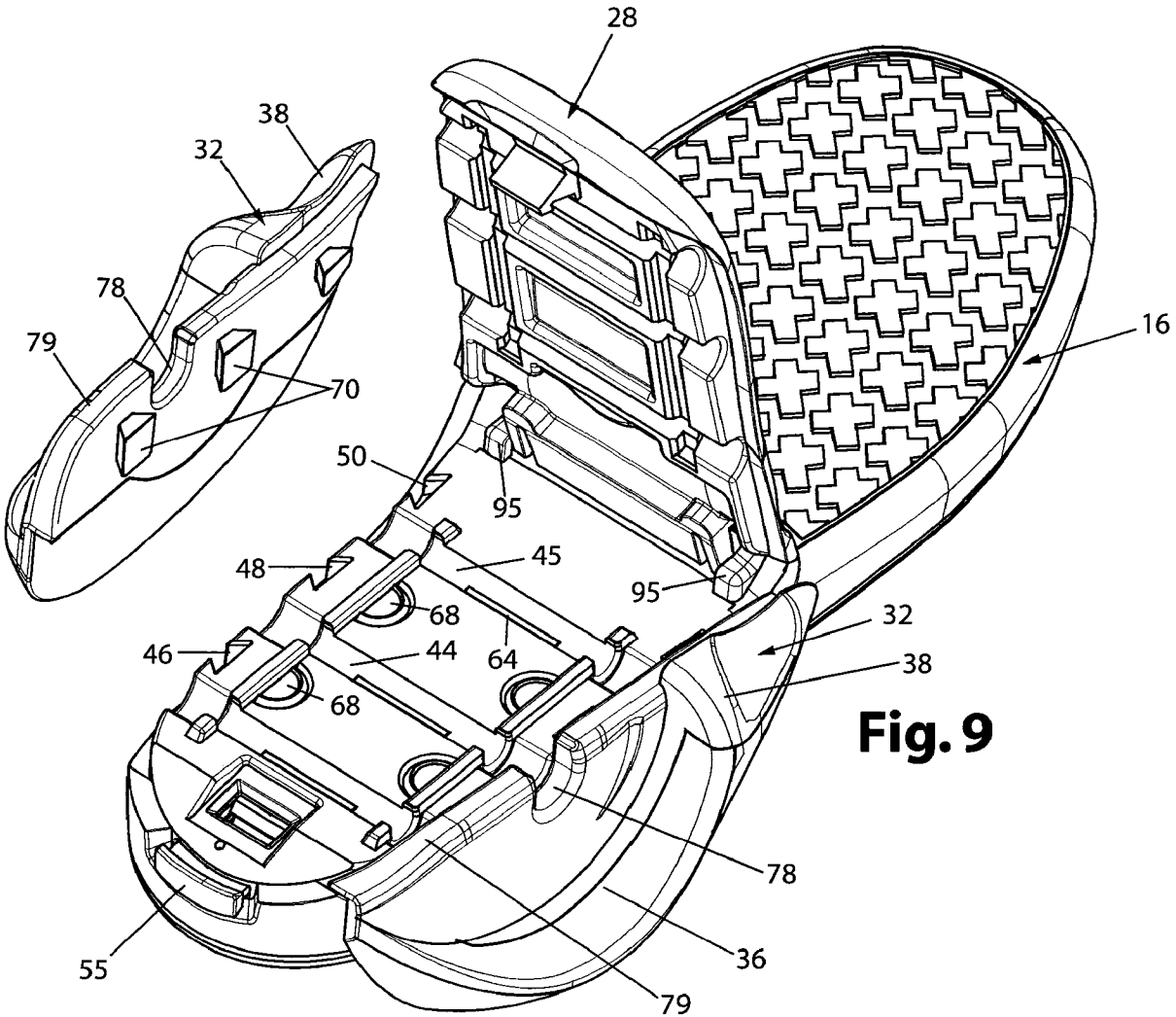
FIG. 9 is a perspective view of the sole of FIG. 4 with the cover plate hinged open and a side fender for a single pair of wheels installed on one side of the exposed portion of the heel of the shoe.
Figure 10:
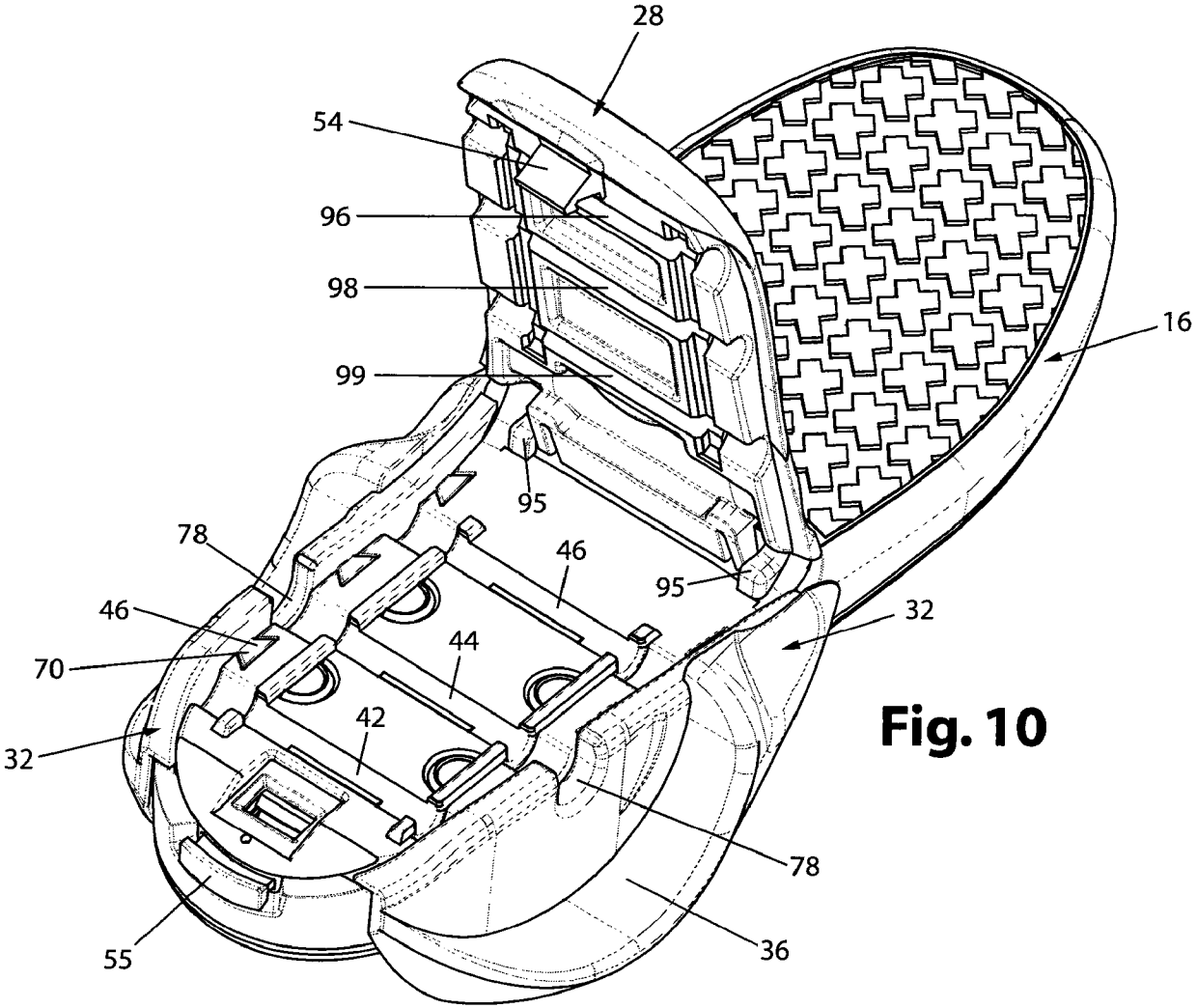
FIG. 10 is a perspective view similar to FIG. 9 illustrating both side fenders installed.
Figure 14:
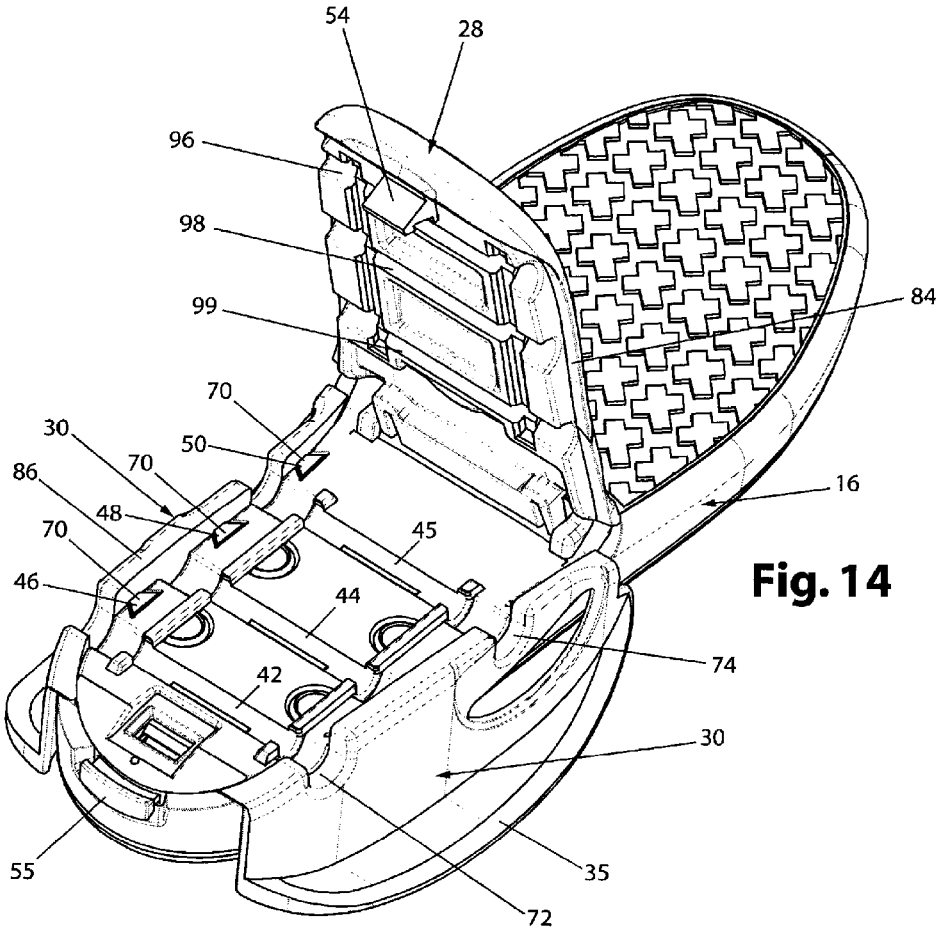
FIG. 14 is a perspective view of the sole in a condition similar to FIG. 10 but illustrating side fenders for two pairs of wheels installed in the exposed portion of the heel.
Figure 15:
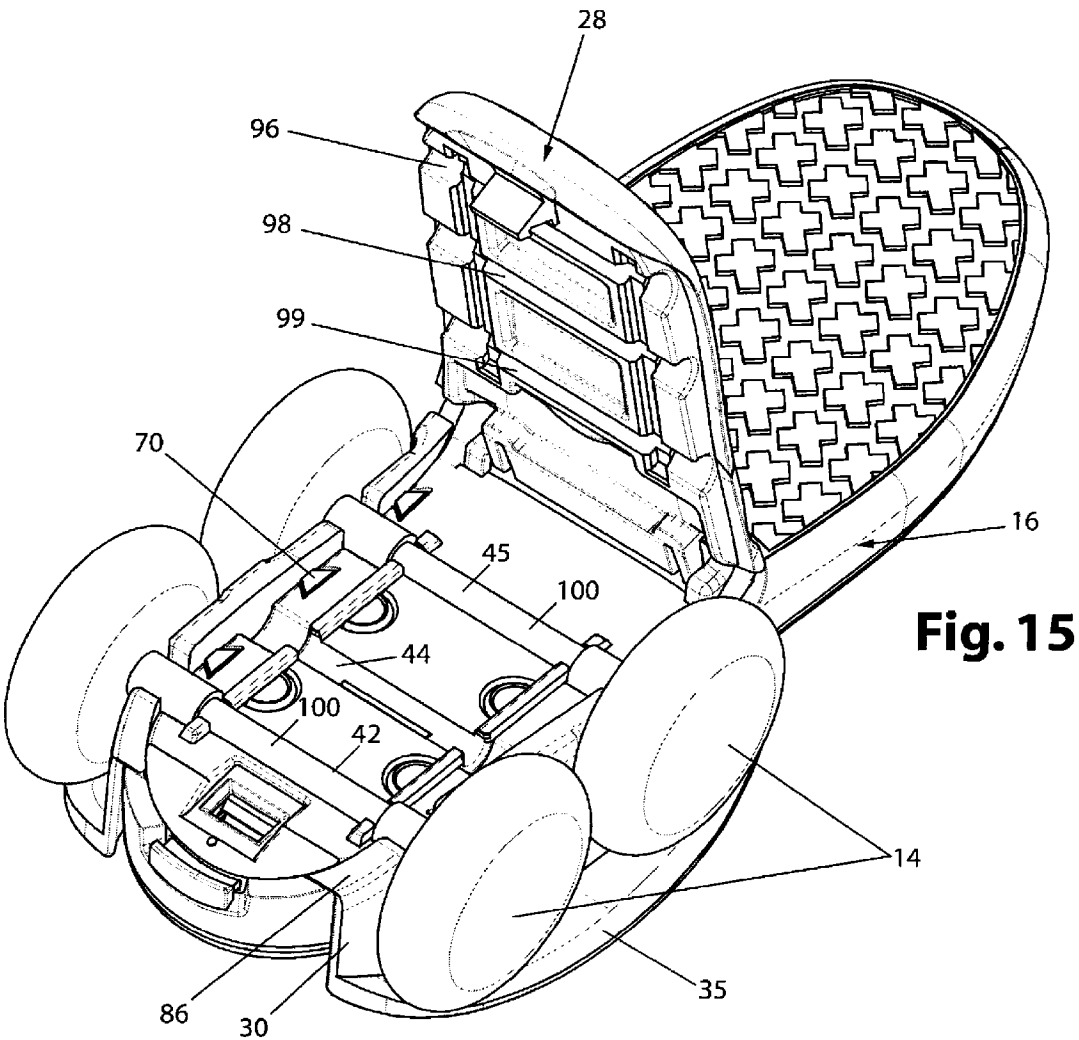
FIG. 15 is a perspective view similar to FIG. 14 illustrating two pairs of wheels installed with the wheel axles engaging in respective axle mounting grooves in the exposed portion of the heel.
Figure 16:
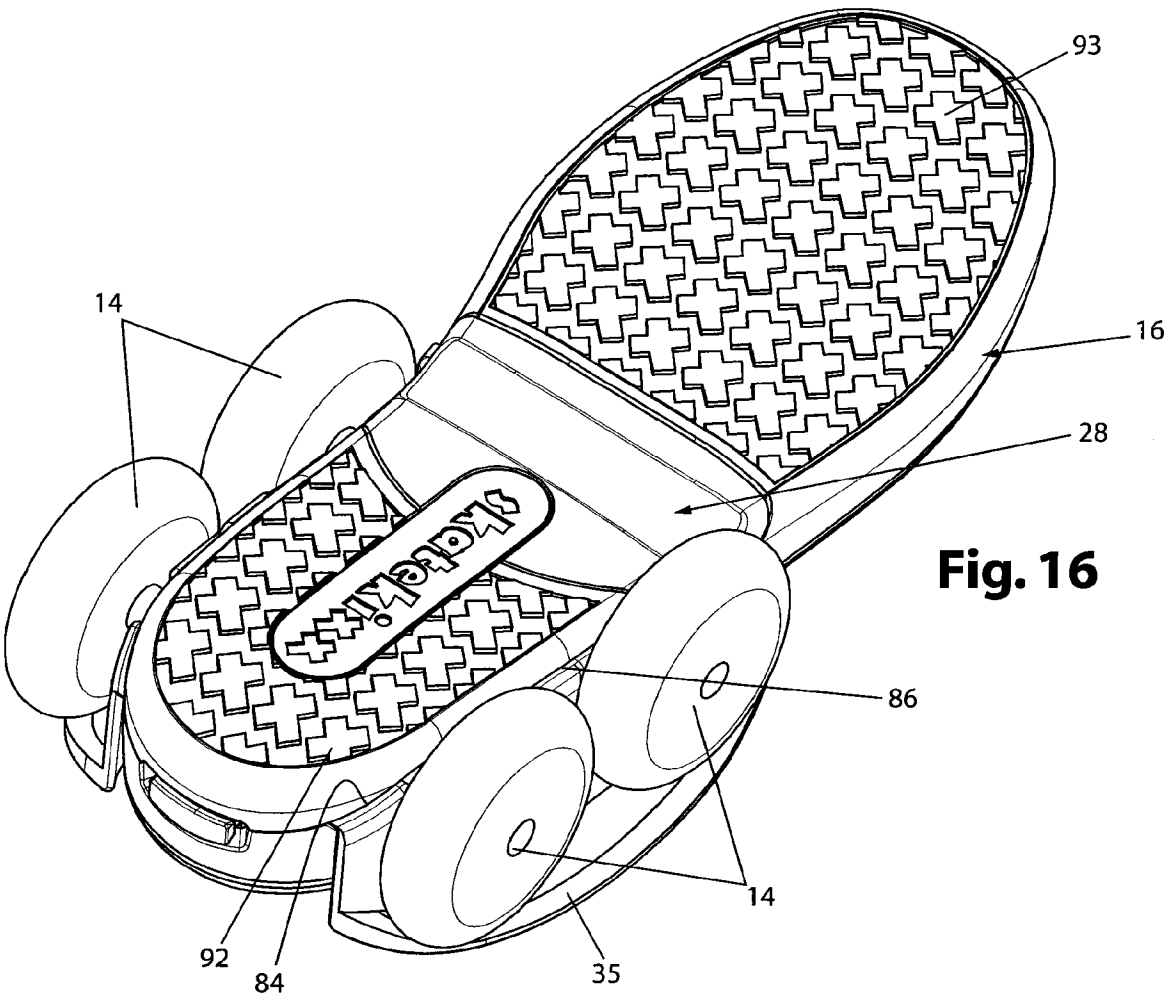
FIG. 16 is a perspective view similar to FIG. 15 illustrating the heel cover plate closed over the wheel axles.
Figure 19:
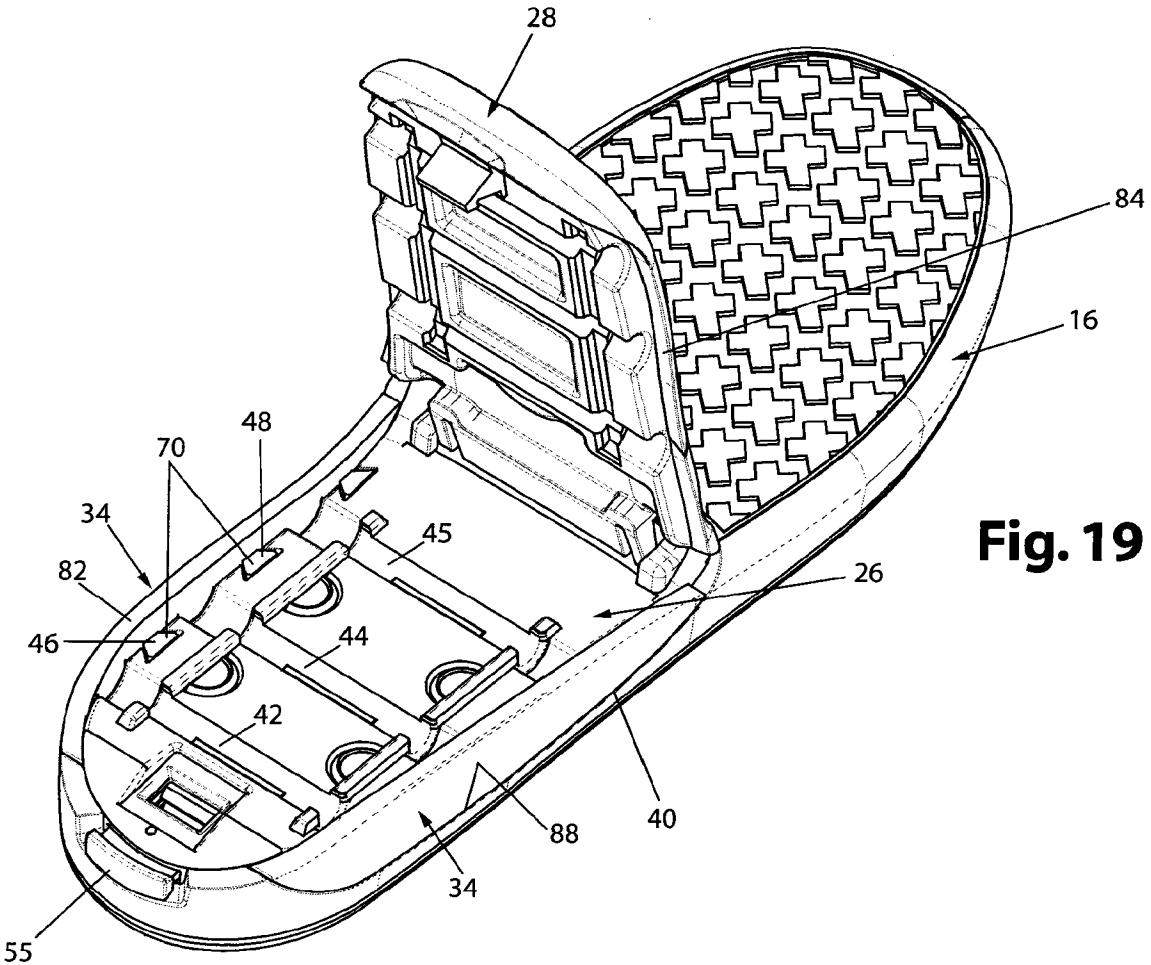
FIG. 19 is a perspective view similar to FIG. 18 with the side inserts installed.
Figure 20:
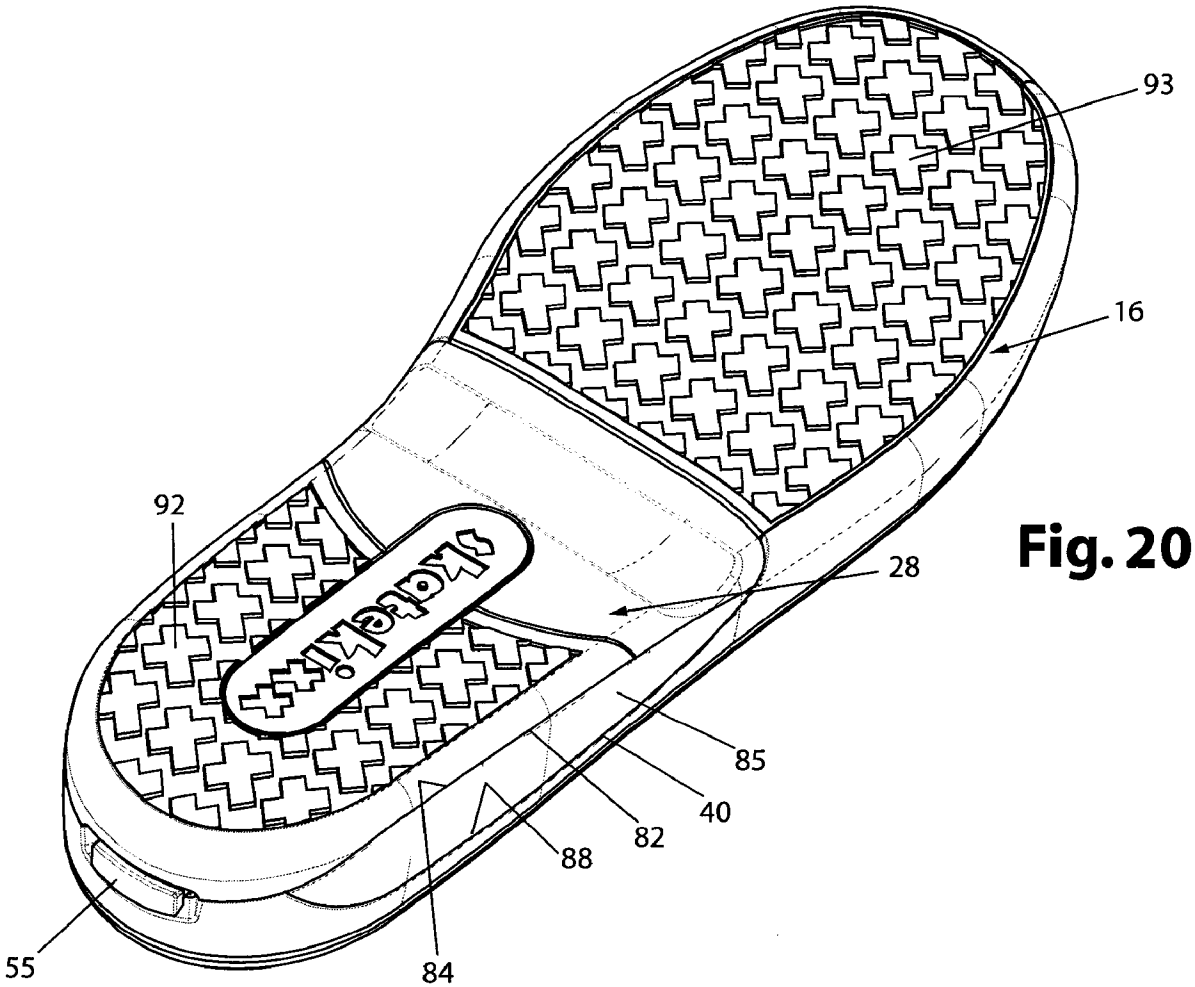
FIG. 20 is a perspective view similar to FIGS. 18 and 19 with the side inserts installed and the heel cover plate closed.
Figure 22:
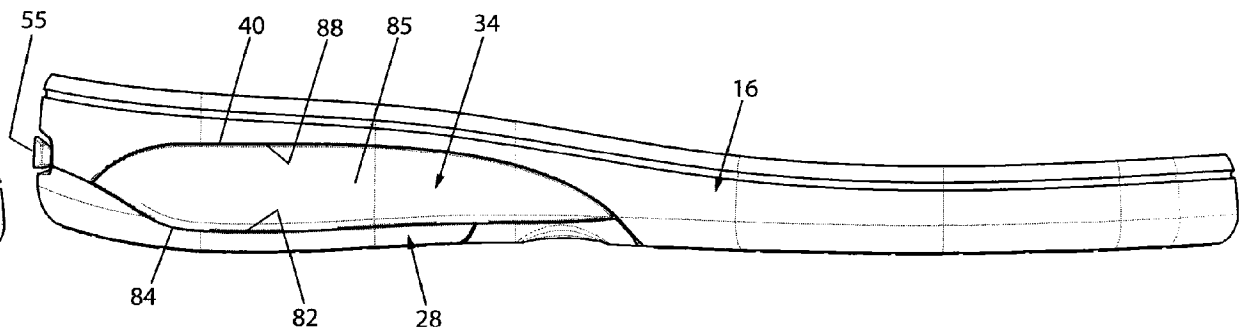
FIG. 22 is a side elevation view of the sole assembled as in FIGS. 20 and 21, with plugs inserted in the wheel axle openings.
Figure 21:
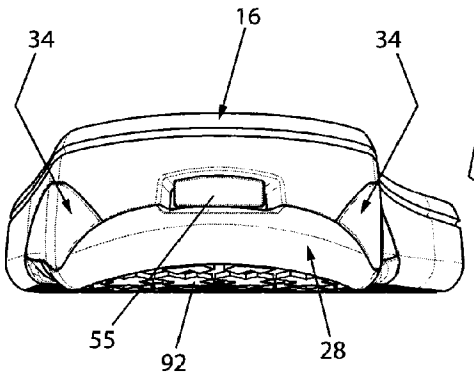
FIG. 21 is a rear elevation view of the sole when assembled as in FIG. 20.
Figure 23:
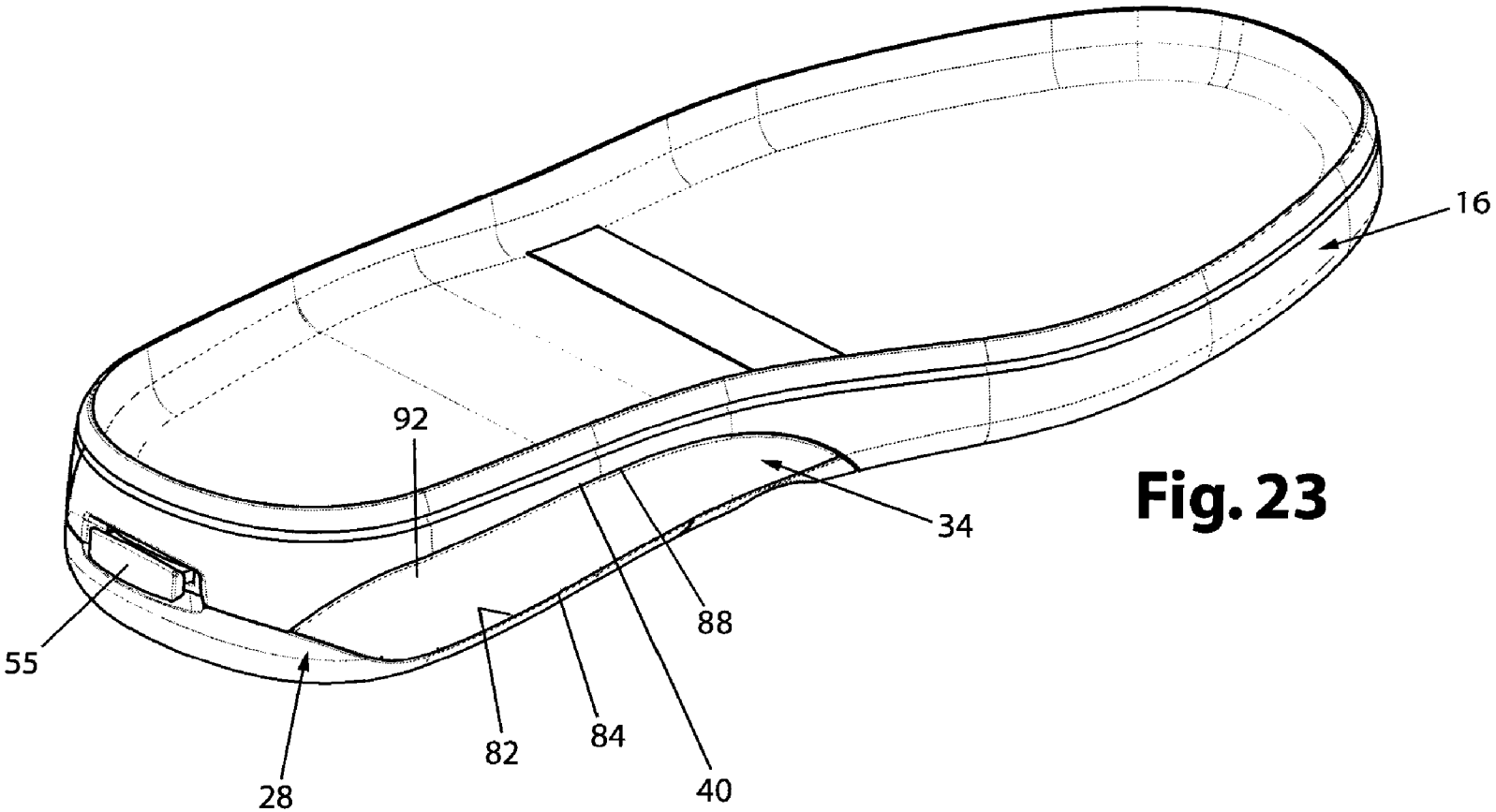
FIG. 23 is a top perspective view of the sole assembled as in FIG. 20, corresponding to FIG. 3 with the shoe upper removed.

The sole 16 has a recessed heel region 26 and a cover plate 28 pivotally mounted at the forward end of the recessed heel region 26 for movement between the open position seen in FIGS. 9 to 11, 14, 15, 18, and 19, and the closed position of FIGS. 10, 16, and 20. The cover plate 28 is separated from the remainder of the sole for clarity in FIG. 4, and is illustrated in more detail in FIGS. 7 and 8. Other components of the adjustable wheel mounting assembly include two identical pairs of wheels 14, only one of which is illustrated in FIG. 4, and three different pairs of side insert plates 30, 32, and 34. The wheels 14 of each pair are mounted at opposite ends of an axle 100. The first pair of side insert plates 30 are fender plates designed for use with two pairs of wheels 14 as in FIG. 2, and each plate includes a fender 35 for extending partially over each wheel on the respective side of the shoe, as seen in FIG. 2. The second pair of side insert plates 32 are designed for mounting one pair of wheels 14 and each plate 32 has both a fender 36 for extending partially over the wheel on a respective side of the shoe, and a downwardly facing, arcuate grinding surface 38 located forward of the wheel when installed as in FIG. 1. The third pair of side insert plates 34 are used when no wheels are to be installed and are designed simply to cover the gap between the indents 40 on each side of the recessed region 26 of the sole and the underlying side edges 84 of the cover plate 28, as seen in FIG. 3.

Figure 5:
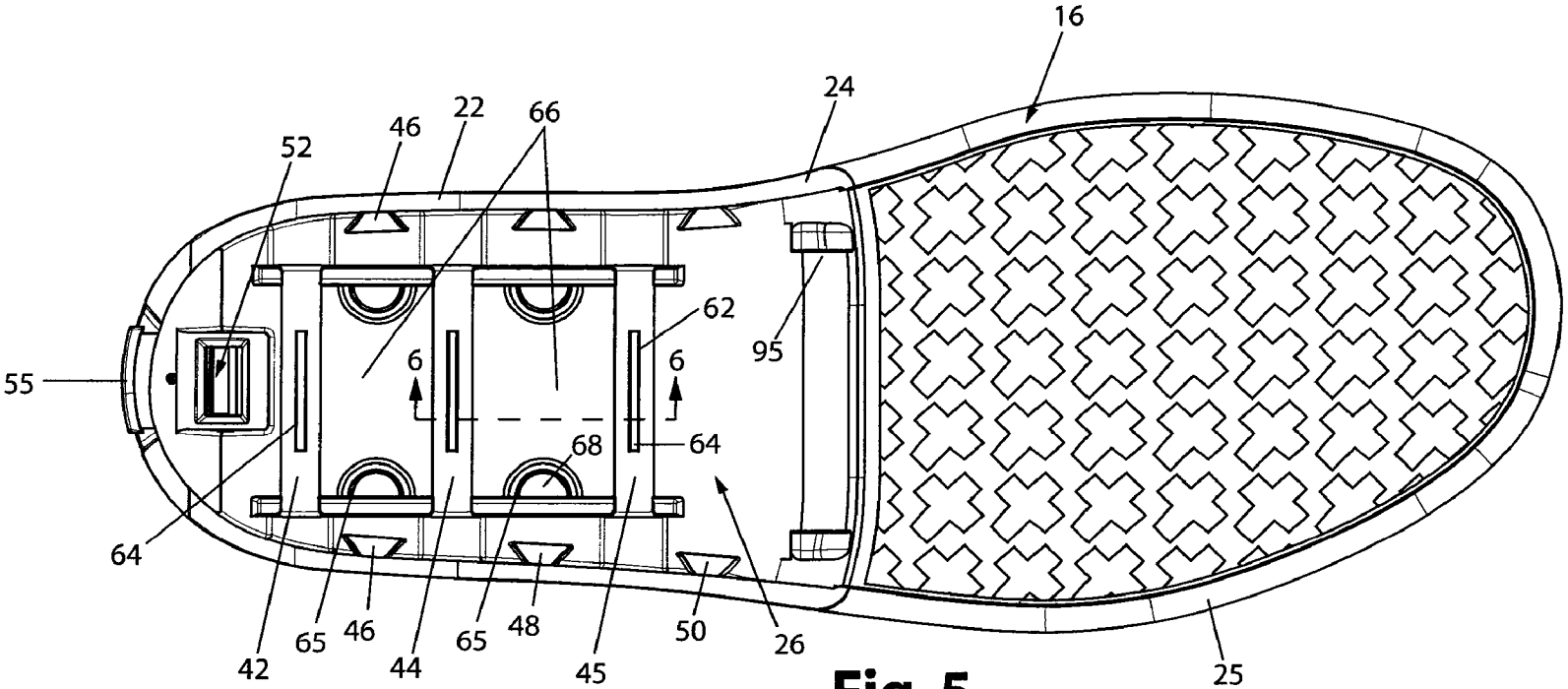
FIG. 5 is a bottom plan view of the sole of FIG. 4 with the cover plate removed.
Figure 6:
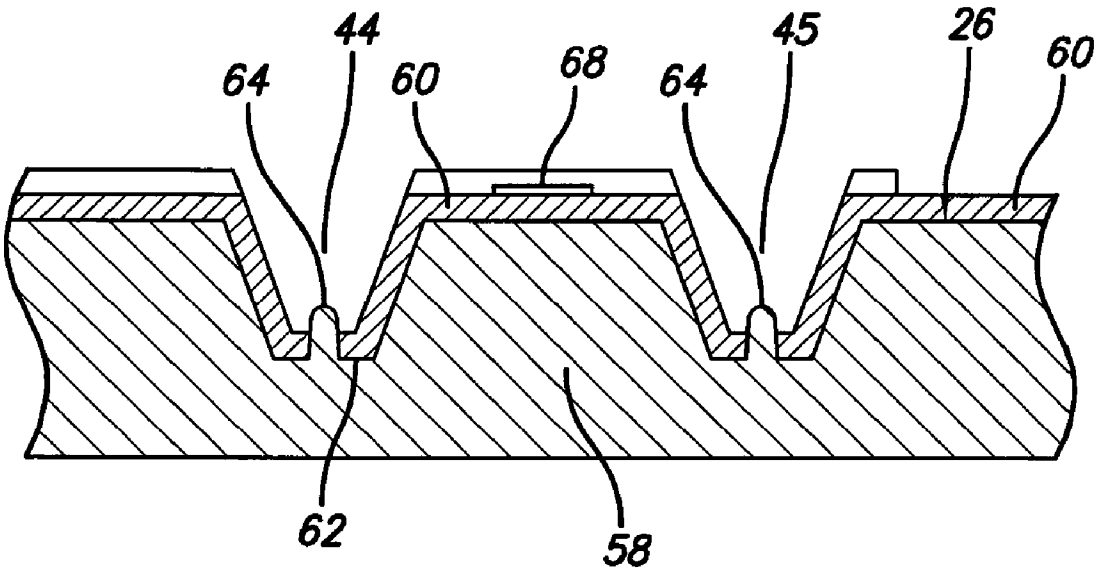
FIG. 6 is a partial cross-section on the lines 6-6 of FIG. 5.

The downwardly facing, recessed region 26 of the sole 16 is illustrated in FIGS. 4 to 6. Three arcuate axle-receiving grooves 42, 44, and 45 extend transversely across recessed region 26, with the first groove 42 located adjacent the heel end of the sole, the second groove 44 spaced forwardly from groove 42, and the third groove 45 spaced forwardly from groove 44 and located close to the arch region 24 of the sole, as best seen in FIG. 5. A series of three downwardly extending pairs of side plate mounting grooves 46, 48, 50 are provided at spaced intervals along the opposite sides of recessed region 26, with grooves 46 positioned between axle mounting grooves 42 and 44, grooves 48 positioned between axle mounting grooves 44 and 45, and grooves 50 positioned between axle mounting groove 45 and the forward end of recessed region 26. As best seen in FIG. 5, each side plate mounting groove 46, 48, 50 is of dovetail shape.

The recessed heel portion 26 also has a latch mechanism 52 adjacent the heel which is designed for releasable latching engagement with latch member 54 at the rear end of cover plate 28. A latch release member or catch 55 projects from the heel end of the sole and is pressed in to release the cover plate when the wheel arrangement is to be adjusted.

In one embodiment, recessed heel portion 26 is made in two parts, with the first part 56 integral with the forward portion of the sole and made of a standard shoe sole material such as ethylene-vinyl-acetate (EVA) or other foamed plastic or rubber-like material, which has some resilience or cushioning properties, and the second part comprising a cover layer 60 of harder material such as nylon or the like. In alternative embodiments, the recessed heel portion may be integrally formed of one material. As illustrated in FIGS. 5 and 6, slots 62 are provided in layer 60 at the lower end of each axle receiving groove 42, 44, 45, and projections 64 from the underlying surface of part 56 project upwardly through each groove. Openings 65 are also provided in the flat portions 66 of layer 60 extending between the adjacent grooves, and projections 68 of corresponding shape project upwardly through each opening 65 from the underlying surface of part 58. The projecting portions of the softer, foam underlayer of the recessed heel portion bear against opposing surfaces of the wheel axles or cover plate when installed, and reduce rattling and clicking noises.

Each of the insert plates 30, 32 and 34 has a series of three spaced dovetail shape projections 70 on its inner face for releasable sliding engagement in the respective dovetail mounting groove 46, 48, and 50, forming a dovetail joint when the respective insert plate is attached to the sole of the shoe, as described in more detail below. The two axle insert plate 30 has two rounded indents 72, 74 on the upper edge 86 as viewed in FIG. 4, which are designed to align with the outer two axle mounting grooves 42 and 45 when the plate is secured to the appropriate side of the indented heel region 26. The outer face 75 is generally flat, with fender 35 projecting outwardly from the arcuate lower edge of face 75, as viewed in FIG. 4 (i.e. the upper edge as viewed in FIG. 2).

Each single axle insert plate 32 has a single rounded indent 78 at its upper edge 79 as viewed in FIG. 4, which is designed to align with the central axle mounting groove 44 when the plate is secured to the appropriate side of the indented heel region 26. Fender 36 also projects outwardly from the arcuate lower edge of plate 32 as viewed in FIG. 4, while an outwardly projecting bulbous portion at the forward end of the plate is formed with an arcuate or rounded grinding surface 38 facing outwardly and generally downwardly when the plate is installed as in FIG. 1.

The no wheel insert plates 34 are each relatively narrow, with a smooth and uninterrupted upper edge 82. The lower edge 88 of each plate as viewed in FIG. 4 is rounded to match the shape of the respective indented side edge 40 on opposite sides of the heel region 26. The plates 34 are of rubber-like material matching that of the outsole 16 of the shoe, and are each shaped to follow the curvature of the outsole along the respective side of the heel region 26.

The insert plates may each be made in one piece of a suitable material matching that of the remainder of the outsole, typically a rubber-like material, and have outer faces designed to match the appearance of the adjacent regions of the outsole when installed. However, in one embodiment the insert plates 32 used in the single wheel configuration are made in two parts which are suitably secured together by adhesive, a tongue and groove engagement, or the like, to allow the grinding surface 38 to be made of a harder, more durable material such as nylon or the like. The dividing line 90 between the two parts of the insert plates 32 can be seen in FIG. 4, with the part above line 90 in FIG. 4 being of harder material and the part below line 90 being of a material matching that of the remainder of the sole of the shoe, such as EVA.

Figure 7:
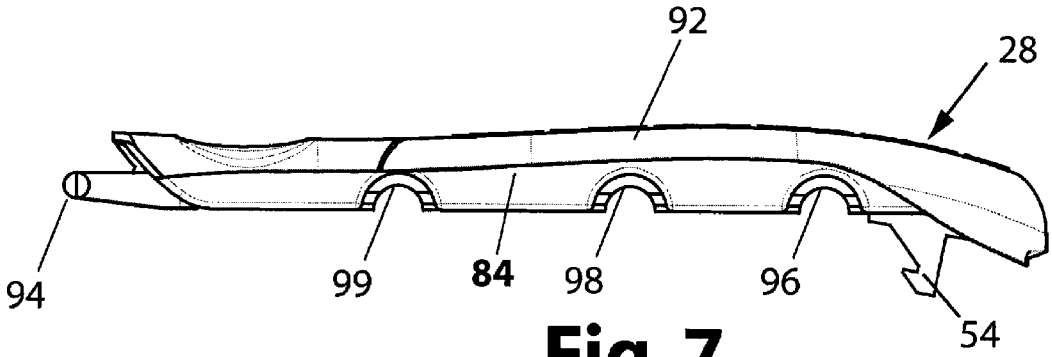
FIG. 7 is a side elevation view of the heel cover plate of FIG. 4.
Figure 12:
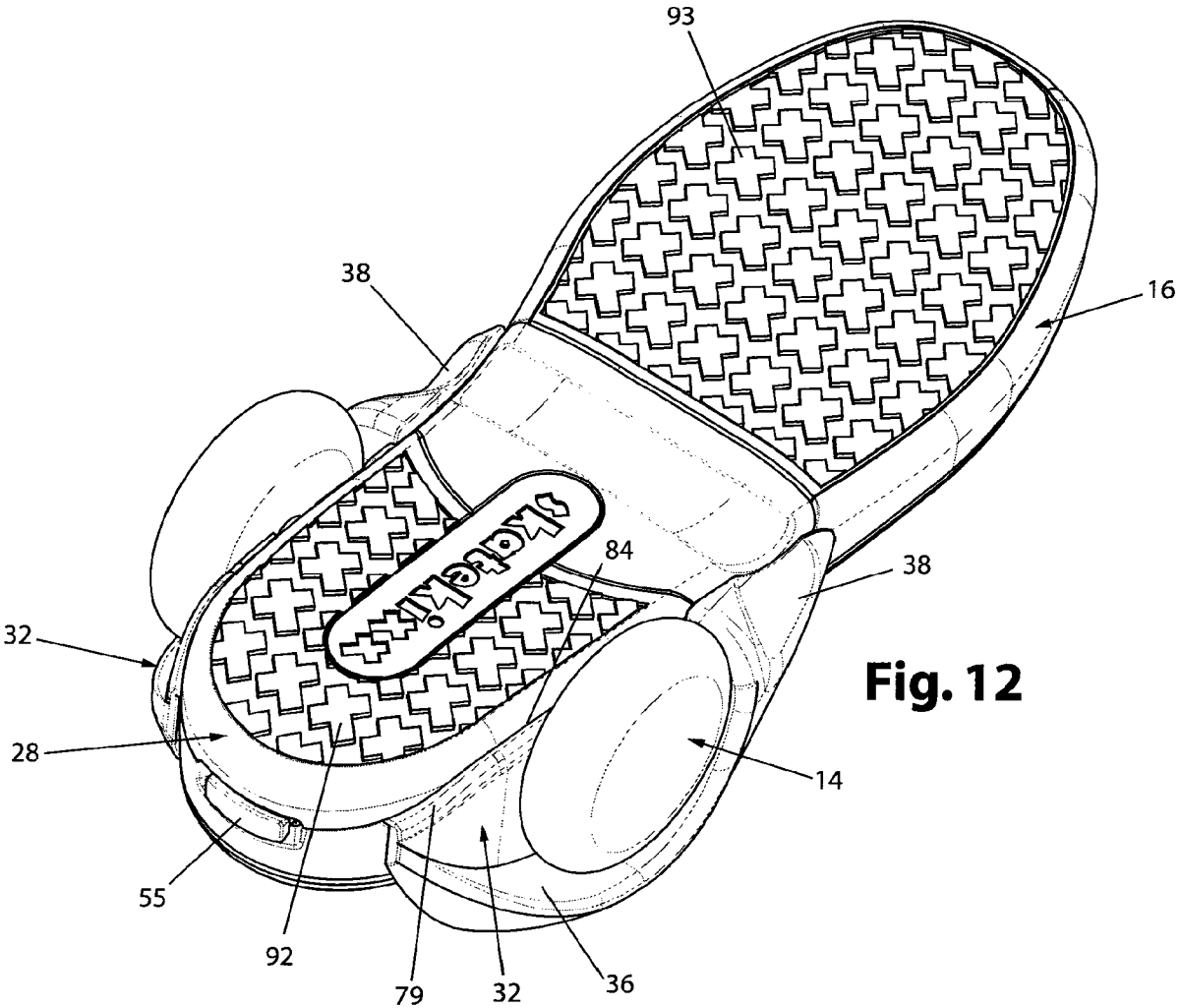
FIG. 12 is a perspective view similar to FIGS. 9 to 11 illustrating the sole of the shoe with the cover plate closed and one pair of wheels installed along with a side fender and grind plate insert associated with each wheel.

The hinged cover plate 28 is illustrated in detail in FIGS. 4, 7, and 8. The outer face of plate 28 is covered by a layer 92 of rubber braking material and is designed to extend flush with the remainder of the lower surface of the sole when closed, as seen in FIG. 12, for example. The layer 92 matches the design of the forward rubber layer or surface 93 of the sole. The inner face is designed for engagement with the opposing face of the indented heel region 26 of the sole, and the outer side edges 84 engage with corresponding upper edges 86, 79 or 82 of the respective side insert plates when the cover is closed, depending on which side insert plate is in use. Each side plate upper edge is shaped to match the corresponding lower side edge 84 of the cover plate.

Hinge or pivot pins 94 at the forward end of the plate 28 are designed for pivotal engagement in corresponding pivot brackets 95 at the forward end of heel region 26, as indicated in FIGS. 4 and 9. As noted above, latch member 54 at the rear end of plate 28 is in releasable latching engagement with the latch mechanism 52 at the rear end of the indented heel region 26 when the cover plate is in the closed position. The inner surface of plate 28 has a series of three spaced, transverse grooves 96, 98, 99 which are aligned with the corresponding axle receiving grooves 42, 44 and 45 when the plate is closed over the heel region 26. When the cover plate is closed and latched, the protruding ends of foam material projections 58 on heel region 26 bear against opposing surface portions of the cover plate to reduce clicking or rattling of this part during movement of the wearer of the shoe.

Figure 11:
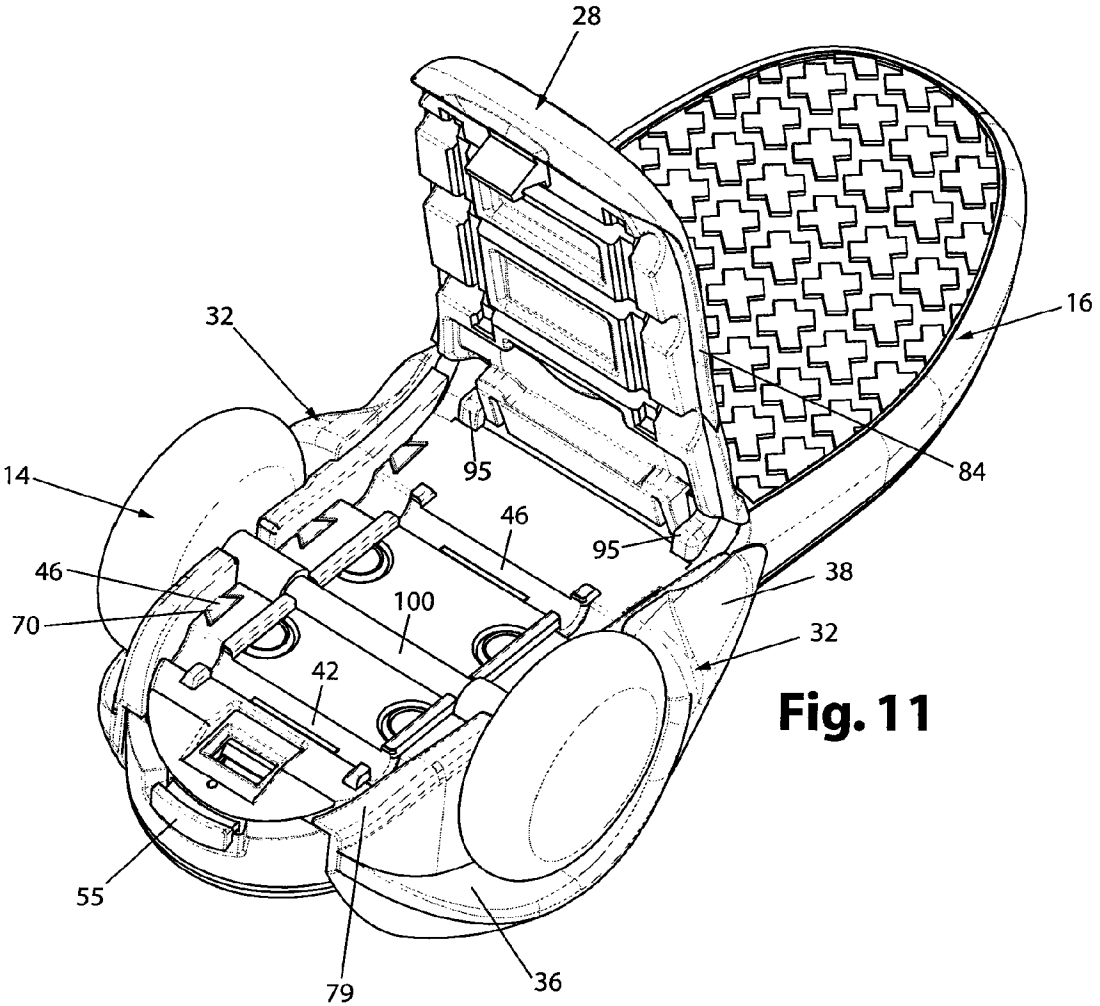
FIG. 11 is a perspective view similar to FIGS. 9 and 10 illustrating installation of the single pair of wheels.
Figure 13:
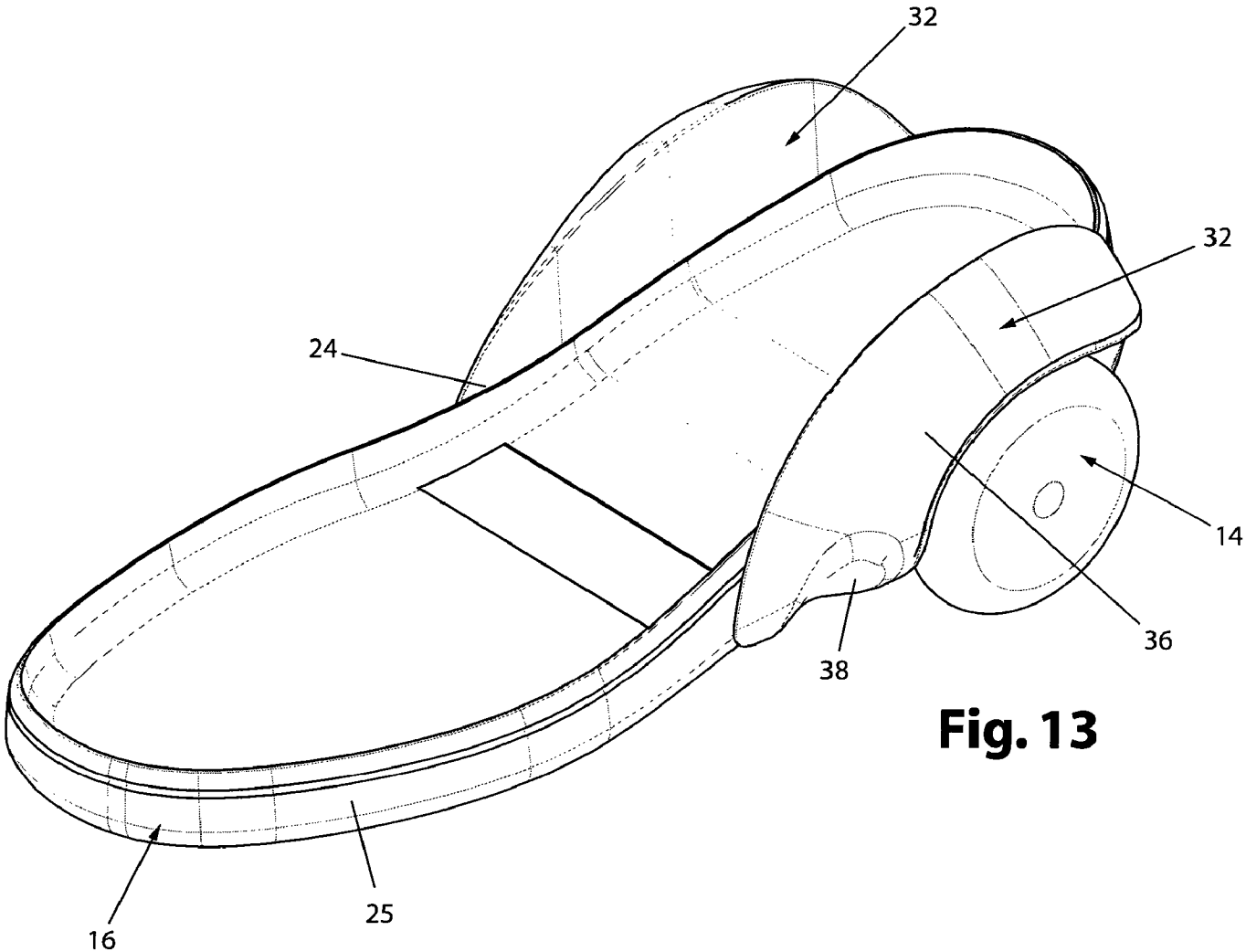
FIG. 13 is an upper perspective view of the sole when assembled as in FIG. 12, corresponding to FIG. 1 with the shoe upper removed.

The method of assembling the footwear 10 with one pair of wheels 14 is illustrated in FIGS. 9 to 13. First, the shoe is turned upside down with the sole uppermost. The latch release 55 is pushed in to release the latch member 54 and allow the cover plate to be pivoted into the open position of FIG. 9. Any insert plates or other components previously installed are removed, leaving the indented heel region completely exposed. The single wheel insert plates 32 are then engaged with opposite sides of heel region 26, by aligning the dovetail tabs 70 with respective dovetail slots or grooves 46, 48 and 50, and then sliding the tabs downwards until they are fully engaged in the slots, as indicated for the right hand insert plate 32 in FIG. 9. FIG. 10 illustrates both insert plates 32 fully installed on opposite sides of heel region 26. A single pair of wheels 14 is then positioned so that the axle 100 engages in the central groove 44 on the heel region and aligned indents 78 in the two side insert plates 32, as indicated in FIG. 11. The axle sits on the foam projection 64 from slit 62 in the base of groove 44. Once the axle 100 is properly positioned, the cover plate 28 is closed and latched over the heel region 26, inner regions of the side plates 32, and the wheel axle, with the central groove 98 in the cover plate engaging over the opposing groove 44 and axle. When the cover plate is closed, the outer side edges 84 engage the opposing upwardly facing edges 79 of side plates 32 as viewed in FIGS. 9 to 12. The fully assembled position with the cover plate closed is illustrated in FIGS. 12 and 13, and with the attached shoe upper 17 in FIG. 1. The foam projection 64 in the groove 44 bears against the axle to reduce vibration or clicking as the wheels rotate over potentially uneven surfaces.

The single pair of wheels is located approximately at the center of the heel region of the shoe, with the grinding face 38 in the space between the wheel and the arch region 24 of the shoe. The wearer can roll on the wheels 14 or grind on the grinding faces 38, as desired. As seen in FIGS. 1 and 13, the fender 36 projects outwardly over at least part of the rim of the respective wheel 14. The upper portions of the side insert plates 32 which extend above the side rim of the sole may be colored to match adjacent portions of the shoe upper 17, as indicated in FIG. 1. This enhances the appearance of the shoe and makes it less obvious that a separate side plate has been installed.

The above procedure is reversed if the wearer wishes to change from one pair of wheels as in FIG. 1 to either two pairs of wheels as in FIG. 2 or no wheels as in FIG. 3. The latch release 55 is depressed to allow the cover plate 28 to be pivoted back up into the open position, the wheel axle 100 is removed from the groove 44, and the single wheel side plates 32 are removed from the sides of the heel region 26. In order to install two pairs of wheels, the two wheel side plates 30 are engaged on opposite sides of the heel region 26, as indicated in FIG. 14. Each dovetail tab 70 on the inner face of each side plate engages in a respective dovetail slot 46, 48, 50 on the respective side of the heel region, as can be seen for the right hand side insert plate 30 in FIG. 14. When the side plates 30 are installed, indents 72 are aligned with the rearmost axle mounting groove 42 and indents 74 are aligned with the forward mounting groove 45, as seen in FIG. 14.

Figure 17:
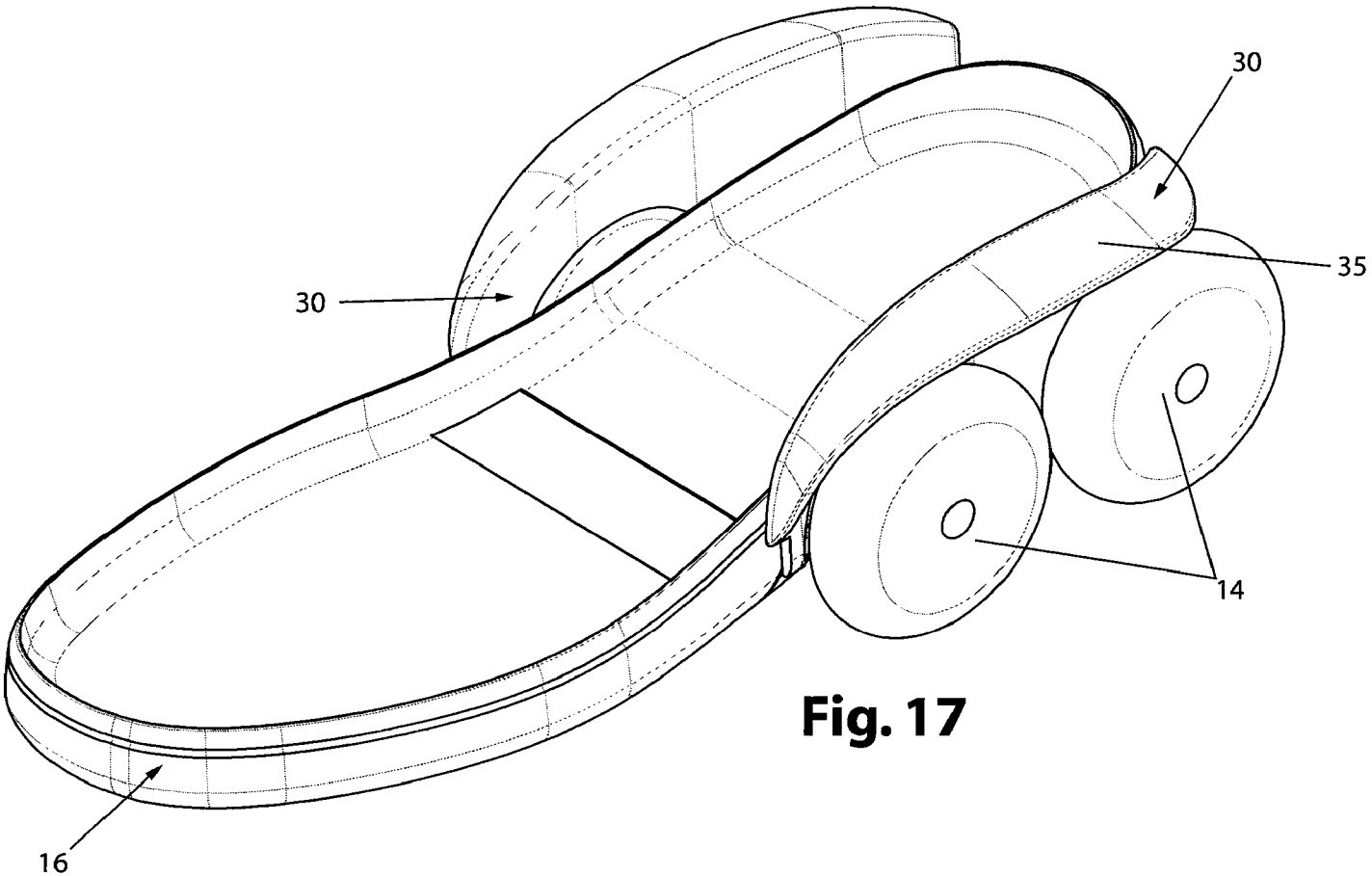
FIG. 17 is a perspective view of the upper side of the sole plate with wheels assembled as in FIG. 16, corresponding to FIG. 2 with the shoe upper removed.
Figure 18:
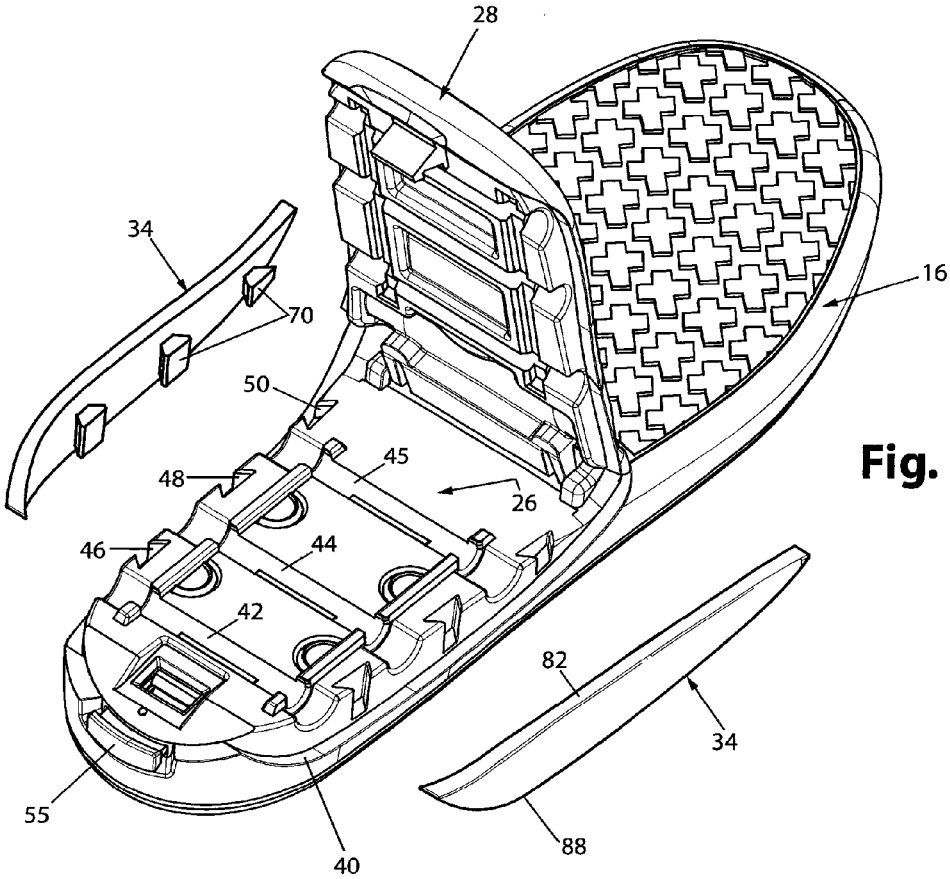
FIG. 18 is a perspective view of the sole with the heel cover plate open and two no wheel side inserts positioned for engagement in the exposed portion of the sole.

Two pairs of wheels 14 are then seated on the heel region, with one wheel axle 100 engaging in the rearmost axle mounting groove 42 and aligned side plate indents 72, and the other wheel axle 100 engaging in the forward mounting groove 45 and aligned side plate indents 74, as seen in FIG. 15. Cover plate 28 can then be closed over the axles and latched in place, with side edges 84 engaging corresponding edges 86 of the side plates 86, holding the wheel axles and the side plates 30 in place, with fenders 35 extending partially over the wheels, as seen in FIGS. 2, 16 and 17.

When assembled as in FIGS. 2 and 16, the rear pair of wheels are positioned adjacent the rear or heel end of the shoe and the wheel dimensions are such that the rearmost portion of each rear wheel is substantially aligned with the rear end of the shoe, as can be seen in FIGS. 1 and 3. The front pair of wheels 14 are positioned a short distance in front of the rear pair of wheels and are located adjacent the arch portion 24 of the sole. As illustrated in FIGS. 2, 15 and 16, the front pair of wheels are mounted for rotation about an axis located between the rear wheels and arch portion 24 of the sole, i.e. axis of front axle 100 mounted in the front axle-receiving groove 45 of FIGS. 14 and 15. The two spaced pairs of wheels provide a wheeled base or platform extending from the rear of the shoe up to a location close to the arch of the shoe. The amount of rearward tilt of the legs required to move between walking and wheeling or rolling is therefore reduced as compared to wheeled shoes with one wheel or a single pair of wheels adjacent the heel. Learning to roll on the shoes or footwear may therefore be easier. The rolling position is relatively stable due to the extended wheel base. In contrast, the single pair of wheels plus grinding surfaces as in FIG. 1 may be used when the wearer wishes to perform more acrobatic moves combining rolling and grinding maneuvers.

In both FIGS. 1 and 2, the fenders extending partially or completely over the wheels provide a more streamlined appearance and reduce the risk of the wheels becoming jammed by any foreign bodies from above. In alternative embodiments, however, the fenders may be eliminated from the one and two wheel side plates, or the fenders may be removably mounted on the side plates so the wearer can decide whether or not to use fenders.

FIGS. 18 to 23 illustrate adjustment of the wheel assembly to remove all wheels and allow the footwear to be used for standard walking, running, sports or the like. The latched cover plate 28 is first opened and any wheels and associated side plates previously mounted on the recessed heel region 26 are removed. The "no wheel" side plates 34 are shown in position ready for mounting on the opposite sides of heel region 26 in FIG. 18. The dovetail tabs 70 on the inner face of each side plate 34 are suitably aligned with the corresponding dovetail slots 46, 48 and 50 on the respective sides of heel region 26, and are then slidably engaged with the slots as indicated in FIG. 19. As is the case with the alternative side plates 30 and 32 for use with wheels, the side plates 34 have lower edges 88 curved to match the curvature of the upper recessed side rims 40 of recessed heel region 26. The upper edge 82 of each plate 34 in the illustrated embodiment is shaped to match the respective downwardly facing outer side edge 84 of the cover plate. When the cover plate 28 is closed and latched, as in FIGS. 20 to 23, the side plates 34 extend over and cover the outer ends of grooves 42, 44, and 46. The smooth outer surface 85 of each plate 34 forms a continuation of the adjacent surfaces of the outsole, with the edge 88 which is uppermost as viewed in the upright position of FIGS. 22 and 23 flush with the corresponding outer side edge 40 of the recessed heel region 26, and the edge 82 which is lowermost flush with the matching upper side edge 84 of the cover plate 28.

Although the different side insert plates are releasably attached to opposite sides of the recessed heel region by sliding dovetail joints in the illustrated embodiment, alternative attachment devices or mating formations may be used in other embodiments. For example, less than three mating formations may provide a connection between each plate and the respective side of the heel region, releasable snap engaging formations may be used, or tongues on the opposite sides of the recessed heel region may engage in one or more slots on the insert plates.

FIG. 3 illustrates the footwear with the side plates 34 installed. It can be seen that the shoe resembles a standard walking shoe in this condition, and can be worn for running, walking, or the like. The ability to convert the footwear for use with or without wheels, and for use with either one or two pairs of wheels, makes this system extremely versatile and allows the footwear to be used in various different ways, including conventional wheeling or rolling, acrobatic maneuvers including grinding, or as a conventional walking, running, or other shoe. The side insert plates used in the three possible configurations have outer surfaces matching adjacent surfaces of the outsole, and may be of the same type of material as the outsole.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. Footwear, comprising:

a sole which supports a foot of a wearer, the sole having a heel portion having a rear end, an arch portion, and a forefoot portion having a forward end;

a first pair of wheels projecting from opposite sides of the sale adjacent the rear end of the heel portion;

a second pair of projecting from opposite sides of the sole in front of the first pair of wheels and adjacent the arch portion of the sole; and the heel portion having a recessed, downwardly facing heel region extending from the arch portion to the rear end of the sole, and a cover plate releasably secured over the recessed heel region, the cover plate having a downwardly facing outer surface matching the lower surface of the remainder of the sole, wherein the first and second pair of wheels are releasably mounted between the recessed heel region and cover plate.

2. The footwear of claim 1, wherein the recessed heel region has at least two spaced axle mounting grooves extending transversely between opposite sides of the recessed heel region, and each pair of wheels has an axle engaged in a respective axle mounting groove.

3. The footwear of claim 2, wherein the recessed heel region has three spaced axle mounting grooves extending transversely between opposite sides of the recessed heel region, the device having a first configuration in which axles of the first and second pair of wheels are engaged in the outermost axle mounting grooves, and a second, one wheel configuration in which the axle of one pair of wheels is engaged in the central axle mounting groove, whereby the footwear device can be selectively converted between a first configuration having two pairs of wheels in the heel region and a second configuration having a single pair of wheels in the heel region.

4. The footwear of claim 1, wherein rearmost portions of said first pair of wheels are at the rear end of the heel region.

5. The footwear of claim 4, wherein the second pair of wheels extend forward from a location in front of the first pair of wheels up to the arch region.

6. A convertible wheeled shoe, comprising:

a sole which supports a foot of a wearer, the sole having a heel, an arch, and a forefoot, and a lower, ground engaging surface, the heel having a rear end and extending from the rear end to the arch of the sole;

the heel having a downwardly facing, recessed region, the recessed region having opposite sides and at least one axle mounting groove extending transversely between the opposite sides of the recessed region;

a cover plate releasably engageable over the recessed region, the cover plate movable between a closed position extending over the recessed region and an open position exposing the axle mounting groove, the cover plate having a lower surface which forms a continuation of the lower, ground-engaging surface of the sole in the closed position; and at least one pair of wheels connected by an axle which is releasably engageable in the axle mounting groove with the wheels projecting from opposite sides of the heel, the cover plate holding the axle in the axle mounting groove in the closed position;

the shoe being convertible between a first, wheeled configuration in which the pair of wheels are mounted in the heel of the sole with the wheel axle secured between the recessed region and cover plate, and a second, wheel-less configuration in which the cover plate is closed over the recessed region with the pair of wheels removed and no wheel axle engaged in the axle mounting groove.

7. The shoe of claim 6, further comprising a second pair of wheels having an axle connecting the wheels, the recessed region having at least two spaced axle mounting grooves and the shoe being convertible between the first wheeled configuration in which the axle of only one pair of wheels is engaged in one of the axle mounting grooves and a second wheeled configuration in which the axles of both pairs of wheels are engaged in respective axle mounting grooves.

8. The shoe of claim 6, further comprising a second pair of wheels having an axle connecting the wheels, the recessed region having first, second, and third spaced axle mounting grooves, the first axle mounting groove spaced from the rear end of the recessed region, the second axle mounting groove spaced forward from the first axle mounting groove, and the third axle mounting groove located between the second axle mounting groove and the arch, the shoe being convertible between a first wheeled configuration in which the axle of one pair of wheels is engaged in the second axle mounting groove and the first and third axle mounting grooves are empty, and a second, double wheeled configuration in which the axle of one pair of wheels is engaged in the first axle mounting groove and the axle of the second pair of wheels is engaged in the third axle mounting groove.

9. The shoe of claim 6, further comprising a pair of side insert plates, opposite sides of the recessed region each having a first mating formation and each side insert plate having an inner surface having a second mating formation which is releasably mateable with the first mating formation at a respective side of the recessed heel region, each side insert plate having an upper edge having an arcuate indent which engages over a wheel axle in the first configuration.

10. The shoe of claim 9, wherein each side insert plate has an outer surface matching adjacent outer regions of the sole.

11. The shoe of claim 9, wherein each side insert plate has an outwardly projecting fender which extends at least partially over a respective wheel when the shoe is assembled with a pair of wheels and the side insert plates in the first, wheeled configuration.

12. The shoe of claim 11, wherein each side insert plate has a downwardly facing, arcuate grinding surface spaced forward from the respective wheel when the shoe is assembled in the first, wheeled configuration.

13. The shoe of claim 9, further comprising a second pair of side insert plates which are assembled on opposite sides of the recessed region between the recessed region and opposing sides of the cover plate in the second, no wheel configuration of the shoe, the outer surface of each second side insert plate being shaped and configured to match adjacent regions of the sole of the shoe.

14. The shoe of claim 8, further comprising a first pair of side insert plates which are engaged on opposite sides of the recessed region in the first wheeled configuration and a second pair of side insert plates which are engaged on opposite sides of the recessed region in the second, double wheeled configuration, each side insert plate having an outer surface shaped and configured to form a continuation of adjacent regions of the sole of the shoe.

15. The shoe of claim 14, wherein each side insert plate of the first pair has an arcuate indent aligned with the second axle mounting groove of the recessed region when assembled on the respective side of the recessed region, the arcuate indent engaging over the single wheel axle in the first wheeled configuration.

16. The shoe of claim 15, wherein each side insert plate of the second pair has first and second spaced arcuate indents which are aligned with the first and third axle mounting grooves of the recessed region when assembled on the respective sides of the recessed region, the arcuate indents engaging over the respective wheel axles in the second, double wheeled configuration.

17. The shoe of claim 16, further comprising a third pair of side insert plates which engage on opposite sides of the recessed region in the wheel-less configuration.

18. The shoe of claim 6, wherein the cover plate is pivotally connected to the recessed region at one end and has at least one latch member, and the recessed region has a latch mechanism which releasably engages the latch member in the closed position of the cover plate.

19. A method of converting footwear between walking and rolling configurations, comprising:

opening a cover plate at the undersurface of the sole of the footwear to reveal a recessed region at the heel;

placing the axle of at least one pair of wheels in an axle receiving groove extending across the recessed region so that the wheels are positioned outside the axle receiving groove on opposite sides of the heel;

closing the cover plate to hold the axle between the recessed region and cover plate in a first wheeled configuration of the footwear;

re-opening the cover plate and removing the wheels from the axle receiving groove; and closing the cover plate over the recessed region to convert the footwear to a non-wheeled configuration.

20. The method of claim 19, further comprising converting the footwear to a double wheeled configuration by opening the cover plate, placing the axles of two pairs of wheels in spaced parallel axle receiving grooves extending transversely across the recessed region so that a first pair of wheels is positioned adjacent the arch region of the sole and a second pair of wheels is positioned behind the first pair of wheels, and closing the cover plate to hold both wheel axles between the recessed region and cover plate.

* * * * *